US007986288B2

(12) United States Patent
Jang et al.

(10) Patent No.: US 7,986,288 B2
(45) Date of Patent: Jul. 26, 2011

(54) LIQUID CRYSTAL DISPLAY DEVICE

(75) Inventors: Chul Sang Jang, Anyang-si (KR); Jin Chul Choi, Gunpo-si (KR)

(73) Assignee: LG Display Co., Ltd., Seoul (KR)

( * ) Notice: Subject to any disclaimer, the term of this patent is extended or adjusted under 35 U.S.C. 154(b) by 1398 days.

(21) Appl. No.: 11/494,035

(22) Filed: Jul. 27, 2006

(65) Prior Publication Data

US 2008/0278427 A1 Nov. 13, 2008

(30) Foreign Application Priority Data

Dec. 28, 2005 (KR) ..... 10-2005-0131214

(51) Int. Cl.
*G09G 3/36* (2006.01)

(52) U.S. Cl. ..... 345/87; 345/88; 345/89; 345/90; 345/55; 345/204

(58) Field of Classification Search ..... 345/87–90, 345/55, 204
See application file for complete search history.

(56) References Cited

U.S. PATENT DOCUMENTS 4,358,713 A * 11/1982 Senoo et al. ..... 315/291
6,943,500 B2 * 9/2005 LeChevalier ..... 315/169.3
7,126,568 B2 * 10/2006 LeChevalier ..... 345/84
2005/0122321 A1 * 6/2005 Akai et al. ..... 345/204

* cited by examiner

*Primary Examiner* — Richard Hjerpe
*Assistant Examiner* — Leonid Shapiro
(74) *Attorney, Agent, or Firm* — Brinks, Hofer, Gilson & Lione

(57) ABSTRACT

An LCD with reduced power consumption is described. The LCD includes a liquid crystal panel having a plurality of gate lines and data lines, a data driver supplying a data voltage to the plurality of data lines, a controller generating a current control signal to control an output terminal of the data driver so that the output terminal operates during a first period in which data is outputted from the data driver, and the output terminal does not operate during a second period in which data is not outputted from the data driver, and a gate driver that supplies a scan signal to the plurality of the gate lines.

9 Claims, 15 Drawing Sheets

LIQUID CRYSTAL DISPLAY DEVICE

This application claims the benefit of priority to Korean patent application 131214/2005, filed on Dec. 28, 2005, which is incorporated by reference herein.

TECHNICAL FIELD

The present application relates to a liquid crystal display device (LCD), and more particularly, to an LCD capable of reducing power consumption.

BACKGROUND

A liquid crystal display (LCD) using an active matrix driving method can display a moving picture image using thin film transistors (TFTs) serving as a switching element. LCDs are widely used in computers (e.g., personal computers and notebook computers, etc.), office automation equipment (a copier, etc.), and portable devices (e.g., mobile phones, beepers, etc.) because of its thinness and lightness.

A liquid crystal panel includes a plurality of pixels arranged in a matrix, and a plurality of TFTs switching a data signal to be applied to each of the pixels. An image is displayed on a screen when the liquid crystal panel controls an amount of transmitted light supplied from a backlight.

The LCD includes a liquid crystal panel displaying an image and a driving unit driving the liquid crystal panel.

The related art LCD shown in FIG. 1 includes a liquid crystal panel 2 having a plurality of gate lines GL0 to GL n and data lines DL1 to DLm arranged to display a predetermined image, a gate driver 4 driving the gate lines GL0 to GLn, a data driver 6 driving the data lines DL1 to DLm, and a timing controller 8 controlling the gate driver 4 and the data driver 6.

TFT switching devices are formed at the intersections of the gate lines GL0 to GLn and the data lines DL1 to DLm, arranged on the liquid crystal panel 2. The TFT is connected to a pixel electrode (not shown), which is overlapped with the gate lines GL0 to GLn to form a storage capacitor Cst.

The gate driver 4 sequentially applies a scan signal (i.e., gate high voltage VGH) to the gate lines GL0 to GLn according to a control signal generated by the timing controller 8.

The data driver 6 supplies a data voltage to the data lines DL1 to DLm according to a control signal generated by the timing controller 8. The data driver 6 includes output buffers (not shown) corresponding to the data lines DL1 to DLm in the liquid crystal panel 2.

Since the output buffers operate during a non-operation period in which data is not being applied to the liquid crystal panel 2, a current is consumed because of driving the output buffers during the non-operation periods. Thus, power consumption is increased. Heat generated from the data driver 6 is maximized. Therefore, malfunctions of the liquid crystal panel 2 can occur due to the heat generating effect.

SUMMARY

A liquid crystal display (LCD) including a liquid crystal panel having a plurality of gate lines and data lines, a data driver supplying a data voltage to the plurality of data lines, a controller generating a current control signal to control an output terminal of the data driver so that the output terminal operates during a first period in which data is outputted from the data driver, and the output terminal does not operate during a second period in which data is not outputted from the data driver, and a gate driver supplying a scan signal to the plurality of the gate lines. Therefore, a current consumption is minimized and thus power consumption is reduced. Additionally, heat generated from the elements can be minimized.

DETAILED DESCRIPTION

Figure 1:
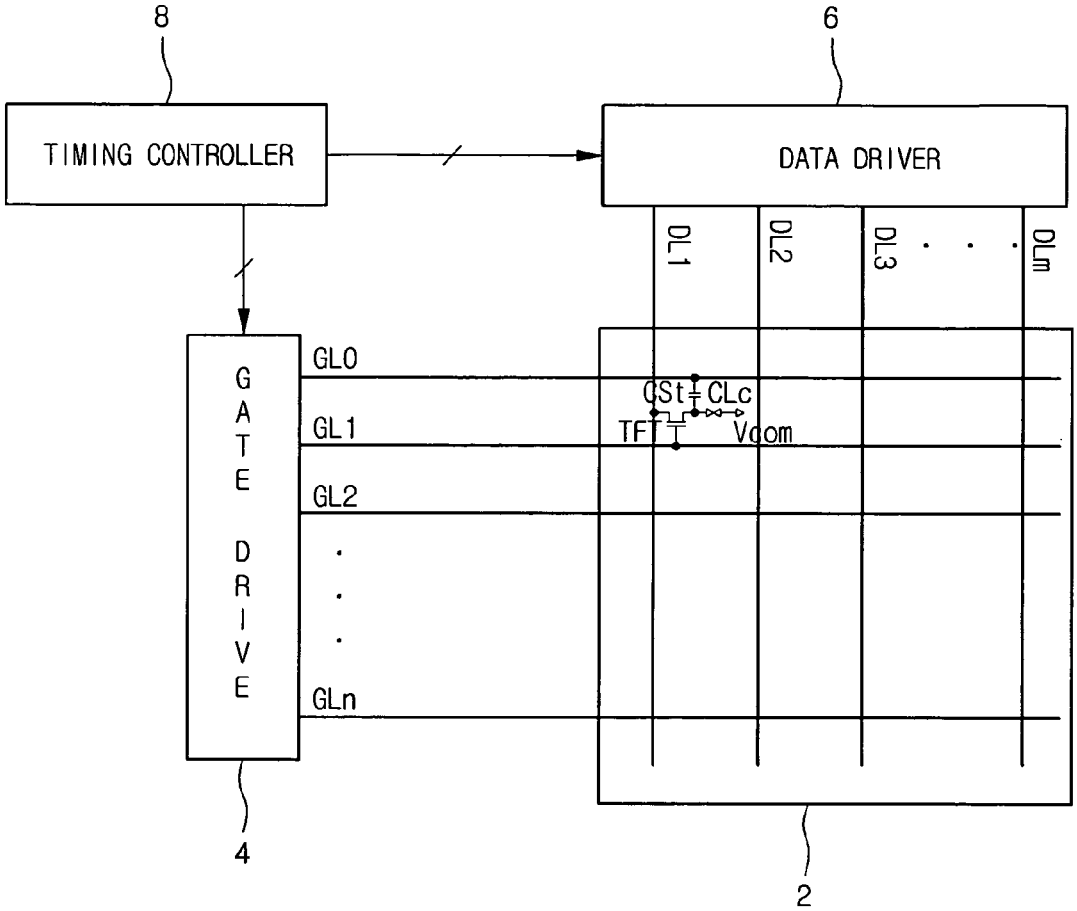
Fig.1 (Related Art)
FIG. 1 is a view of a related art LCD.
Figure 2:
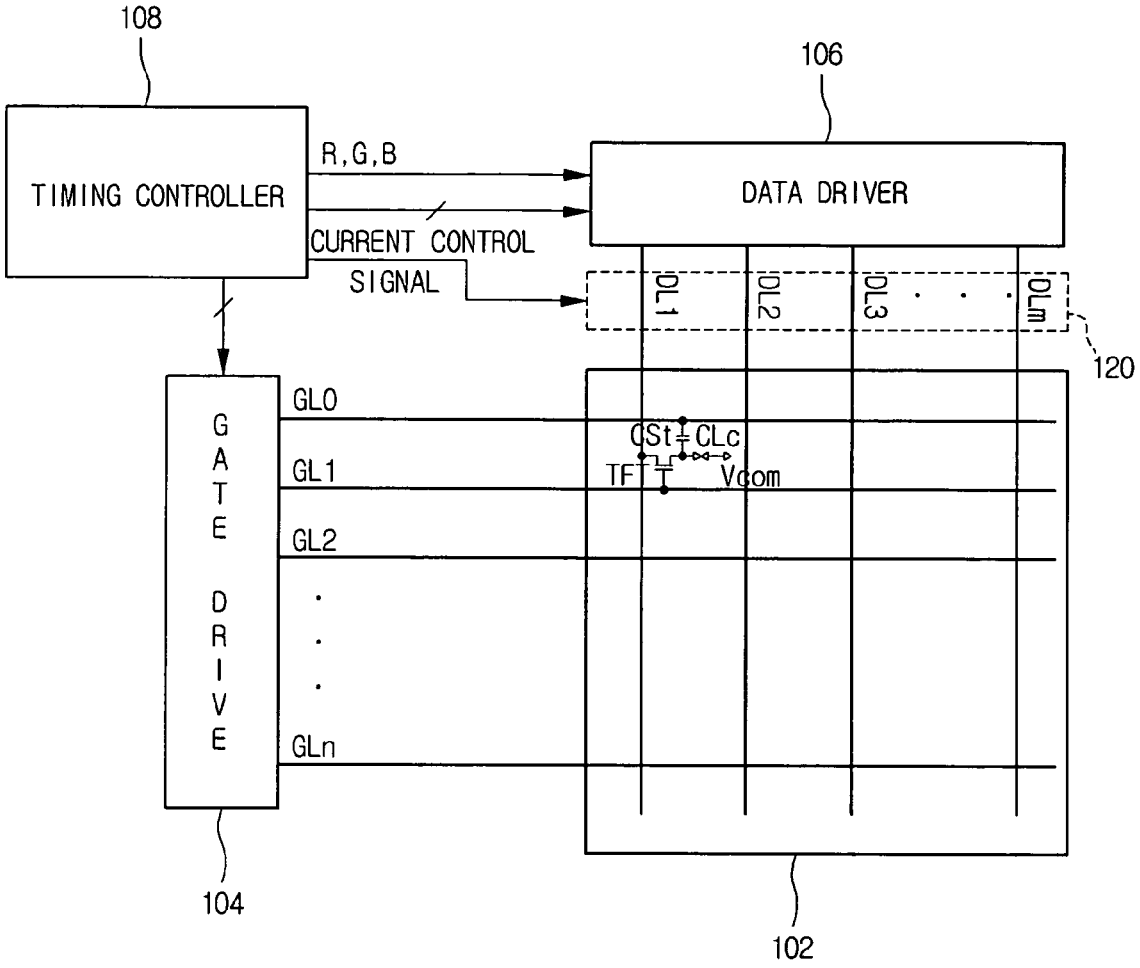
FIG. 2 is a view of an LCD of an embodiment.

Exemplary embodiments may be better understood with reference to the drawings, but these examples are not intended to be of a limiting nature. Wherever possible, the same reference numbers will be used throughout the drawings to refer to the same or like parts FIG. 2 shows an embodiment where the LCD includes a liquid crystal panel 102 to display a image, including a plurality of gate lines GL0 to GLn and data lines DL1 to DLm, a gate driver 104 for driving the plurality of gate lines GL0 to GLn, a data driver 106 for driving the plurality of data lines DL1 to DLm, and a timing controller 108 controlling the gate driver 104 and the data driver 106.

Thin film transistors (TFT) are formed at intersections of the gate lines GL0 to GLn and the data lines DL1 to DLm on the liquid crystal panel 102. The TFTs are connected to pixel electrodes (not shown), which are overlapped with the gate lines GL0 to GLn to form a capacitor Cst.

The gate driver 104 supplies scan signals (i.e., a gate high voltage VGH or a gate low voltage VGL) to the gate lines GL0 to GLn according to a gate control signal supplied from the timing controller 108.

The data driver 106 supplies a data voltage (an analog voltage) to the data lines DL1 to DLm according to a control signal supplied form the timing controller 108. An output terminal 120 of the data driver 106 (hereinafter, referred to as an output terminal) includes a plurality of output buffers (not shown) corresponding to the data lines DL1 to DLm.

The output terminal 120 is controlled by a current control signal supplied from the timing controller 108. For example, when the current control signal is a high state, the output terminal 120 does not operate, and when the current control signal is a low state, the output terminal 120 operates. The timing controller 108 generates a gate control signal, a data control signal, and a current control signal using a Vsync/Hsync signal, a data enable (DE) signal, and a clock signal.

The timing controller 108 generates and supplies a low state current control signal to the output terminal 120 during a period in which a data is not outputted from the data driver 106. A current source for driving the output terminal 120 thus is turned on and supplies a driving current to the output buffers 112-1 to **112-*m*. Therefore, the output buffers 112-1 to 112-*m* operate during the period in which the data is not outputted from the data driver 106**.

As shown in FIGS. 3 to 5, the data driver 106 includes a digital-to-analog converter (DAC) 110 converting a digital data signal supplied from the timing controller 108 into an analog data voltage. The DAC 110 is connected to output buffers 112-1 to **112-*m* corresponding to the data lines DL1** to DLm, respectively.

The data lines DL1 to DLm can be supplied with a charge share voltage or a pre-charge voltage during a charge share period or a pre-charge period, respectively. Also, the data lines DL1 to DLm can be supplied with both of the charge share voltage and the pre-charge voltage during the charge share period and the pre-charge period.

The output buffers 112-1 to **112-*m* are turned on/off by a current from a current source (not shown) that is controlled by a current control signal supplied from the timing controller 108**.

The output buffers 112-1 to **112-*m*** operate using a current supplied from a current source.

The current control signal generated from the timing controller 108 is supplied to the current source.

During the charge share period and the pre-charge period in which data is not outputted from the data driver 106, the output buffers 112-1 to **112-*m* do not operate because the current source 114 does not supply a driving current. Since the output buffers 112-1 to 112-*m* do not operate during the charge share period and the pre-charge period, power consumption may be reduced. Additionally, since the output buffers 112-1 to 112-*m* do not operate during the charge share and pre-charge periods, heat which is generated from elements located inside the output buffers 112-1 to 112*m*** may be reduced.

During the data output period in which the data is outputted from the data driver 106, the output buffers 112-1 to **112-*m* receive data voltages from the DAC 110 and supply the data voltages to the corresponding data lines DL1 to DLm. During the data output period, the output buffers 112-1 to 112-*m* are electrically connected to the data lines DL1 to DLm through the third switch SW3**.

The third switch SW3 is turned on when a high output enable (OE) signal is supplied during the data output period. During the data output period, the output buffers 112-1 to **112-*m* are thus connected to data lines DL1 to DLm, and data voltages are supplied to corresponding to the data lines DL1 to DLm, so that an image corresponding to the data voltages is displayed on the liquid crystal panel 102**.

During the charge share and pre-charge periods, the current source 114 is turned off, and a driving current is not supplied to the output buffers 112-1 to **112-*m* when the high state current control signal from the timing controller 108 is supplied to the current source 114**.

During the data output period, the current source 114 is turned on, and a driving current is supplied to the output buffers 112-1 to **112-*m* when the low state current control signal from the timing controller 108 is supplied to the current source 114. Therefore, the output buffers 112-1 and 112-*m* are connected to data lines DL1** to DLm, and operate during the third operation period.

Whether the output buffers 112-1 to **112-*m*** operate or not is determined by the state of the current control signal.

For example, when a low state current control signal is supplied to the output buffers 112-1 to **112-*m*, the output buffers 112-1 to 112-*m* do not operate. When a high state current control signal is supplied to the output buffers 112-1 to 112-*m*, the output buffers 112-1 to 112-*m* operate, the output buffers 112-1 to 112-*m* receive a driving current from the current source 114**.

Figure 3A:
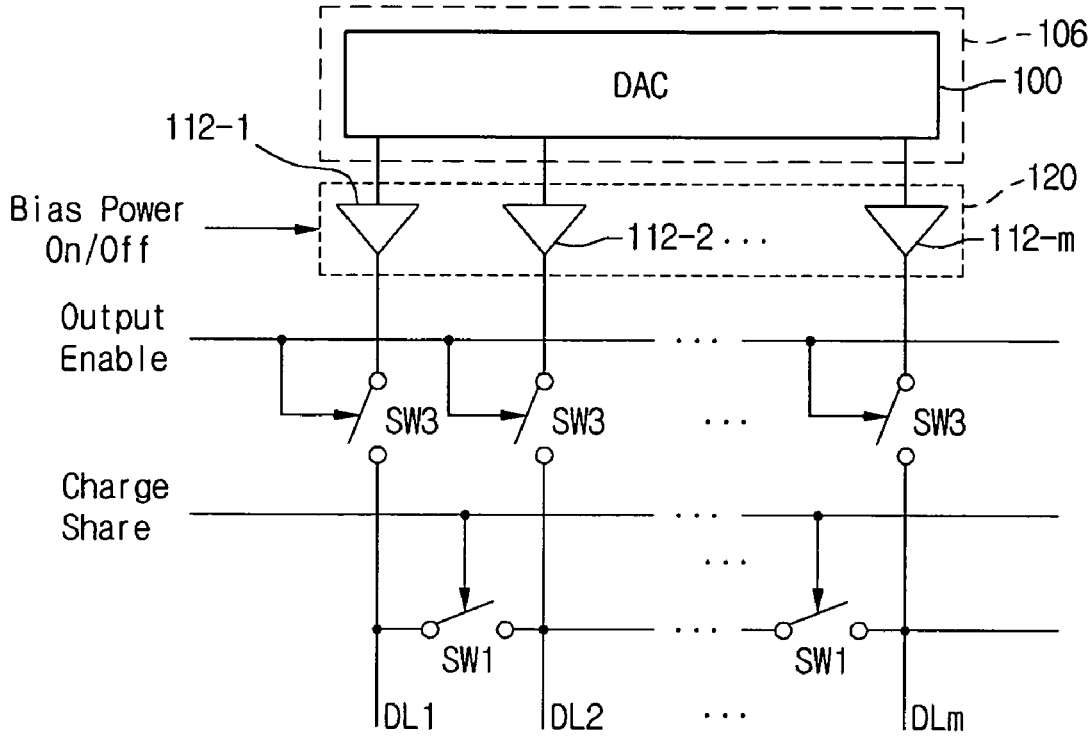
FIG. 3A is a view of an output terminal in a data driver of an embodiment.
Figure 3B:
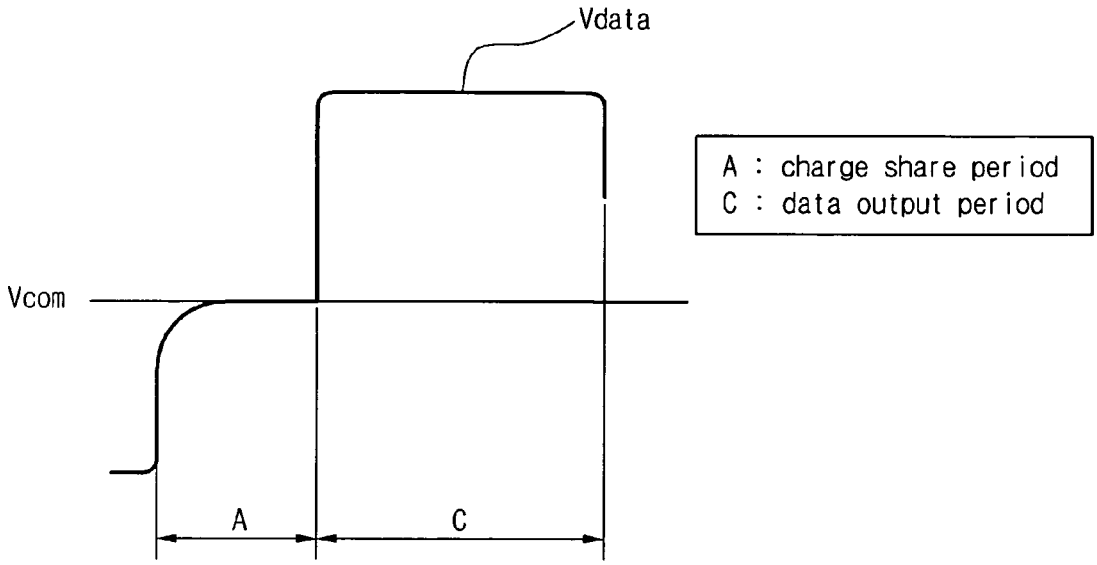
FIG. 3B is a view of an output voltage in a data driver of an embodiment.

As shown FIGS. 3A and 3B, the data driver 106 operates during two operation periods. A first operation period is a charge share period A. A second operation period is a data output period C.

During the charge share period A, a charge share control signal is applied to the first switch SW1, and the first switch SW1 is turned on when a high state charge share control signal is applied to the first switch SW1. The first switch SW1 is arranged in a direction intersecting the data lines DL1 to DLm to connect data lines DL1 to DLm each other through the first switch, and. A voltage corresponding to the common voltage Vcom is supplied to the data lines DL1 to DLm.

During the data output period C, an image corresponding to a data voltage is displayed on the liquid crystal panel 102 of FIG. 2 when a required data voltage is supplied to the data lines DL1 to DLm.

During the first period, the output buffers 112-1 to **112-*m* do not operate (OFF state); during the second period, the output buffers 112-1 to 112-*m*** operate (ON state).

Figure 4A:
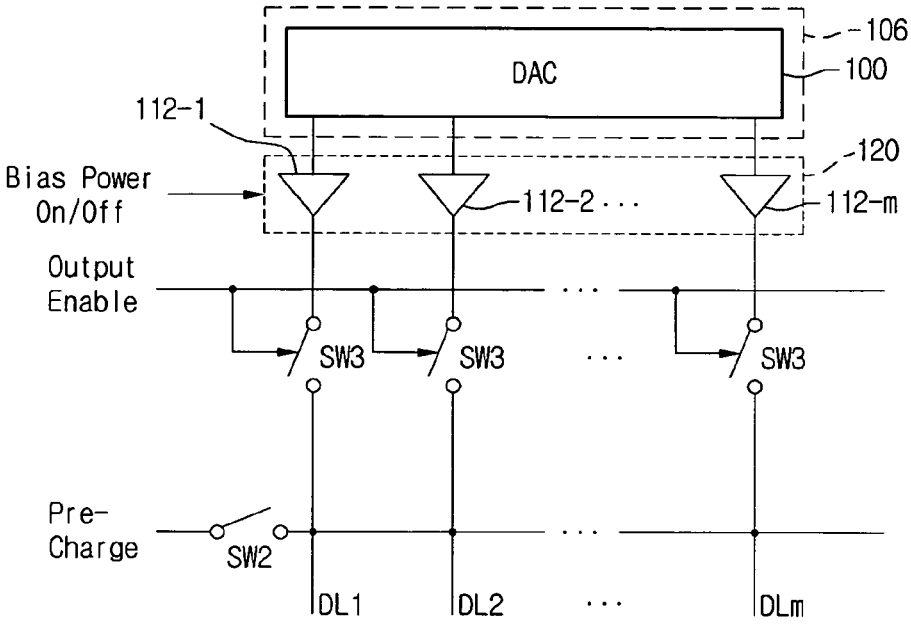
FIG. 4A is a view of another output terminal in a data driver of an embodiment.
Figure 4B:
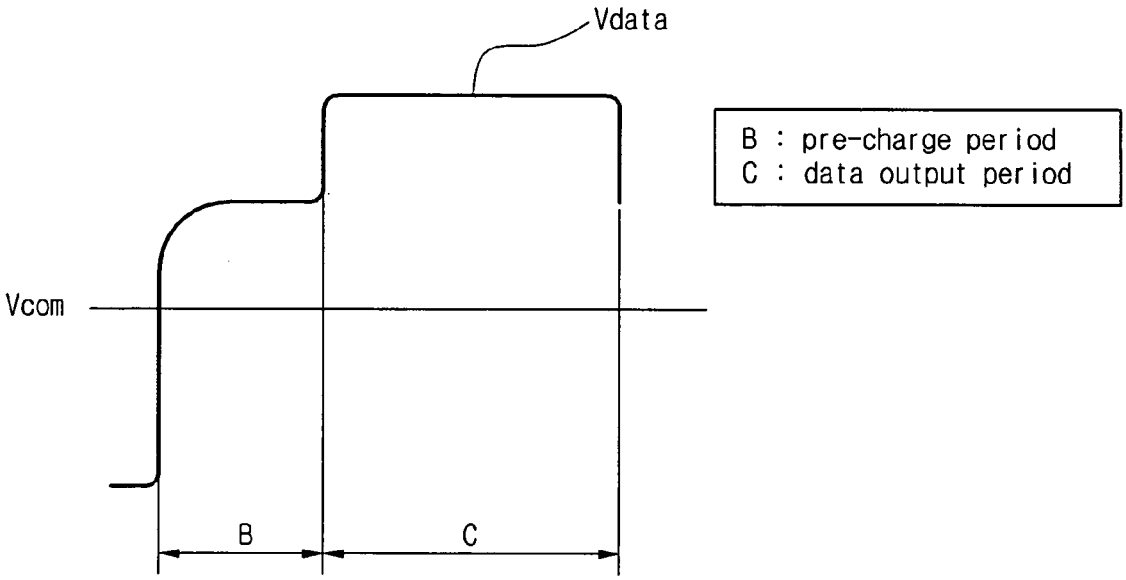
FIG. 4B is a view of another output voltage in a data driver of an embodiment.

As shown FIGS. 4A and 4B, the data driver 106 operates during two operation periods. A first operation period is a pre-charge period B. A second operation period is a data output period C.

In the pre-charge period, a voltage lower than a required data voltage is charged before the required data voltage is supplied to the data lines DL1 to DLm. Thus, power consumption associated with charging the required data voltage can be reduced.

A pre-charge voltage is supplied to the data lines DL1 to DLm. During the pre-charge period B, a voltage higher than the common voltage Vcom is supplied to the data lines DL1 to DLm.

The output buffers 112-1 to **112-*m* do not operate during the pre-charge period B; the output buffers 112-1 to 112-*m*** operate during the data output period C.

Figure 5A:
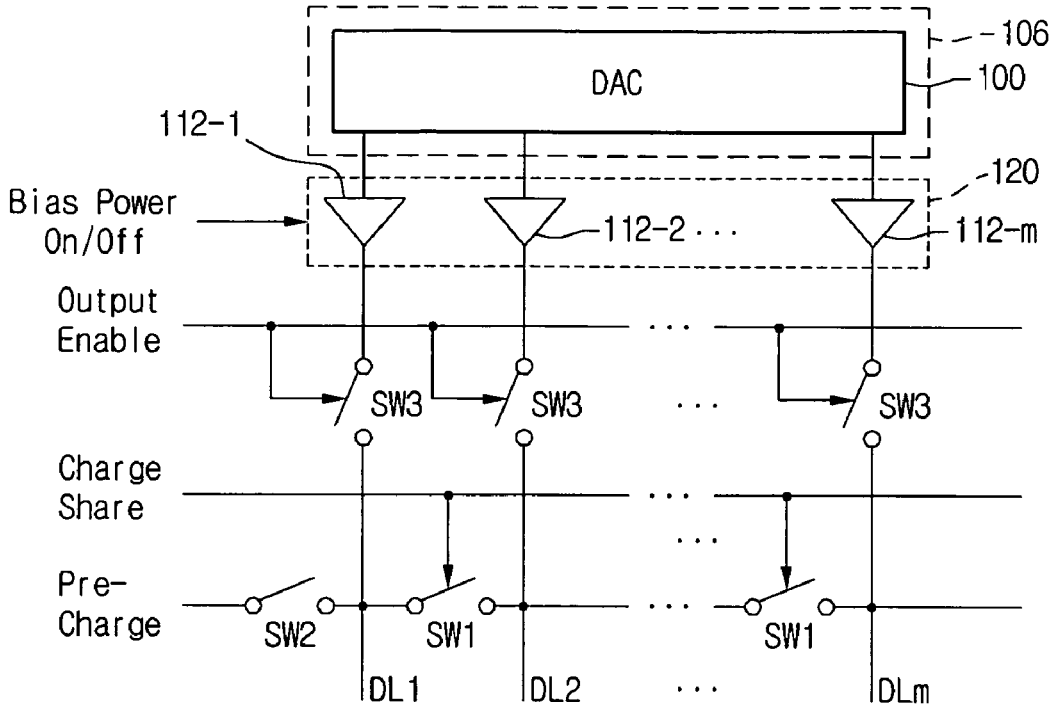
FIG. 5A is a view of another output terminal in a data driver of an embodiment.
Figure 5B:
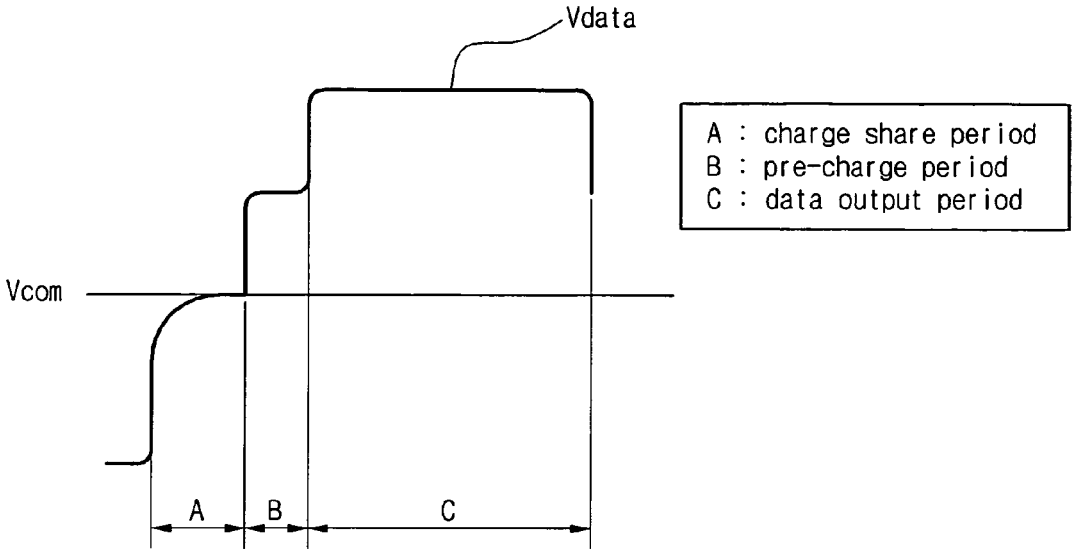
FIG. 5B is a view of another output voltage in a data driver of an embodiment.

As shown FIGS. 5A and 5B, the data driver 106 can operate during three operation periods. A first operation period is a charge share period A. A second operation period is a pre-charge period B. A third operation period is a data output period C.

The data driver 106 includes a digital-to-analog converter (DAC) 110. An output terminal 120 of the DAC 110 includes a plurality of output buffers 112-1 to **112-*m* corresponding to the data lines DL1 to DLm arranged on the liquid crystal panel 102. The LCD with the data driver 106 performs pre-charging through charge sharing. The output buffers 112-1 to 112-*m* are connected through the data lines DL1 to DLm and switches SW1 and SW2**.

A third period is a data output period, and an image corresponding to a data voltage is displayed on the liquid crystal panel 102 of FIG. 2 when a required data voltage is supplied to the data lines DL1 to DLm.

During the first operation period, a charge share control signal is applied to the first switch SW1, and the first switch SW1 is turned on when a high state charge share control signal is applied to the first switch SW1. The first switch SW1 is arranged in a direction intersecting the data lines DL1 to DLm to connect data lines DL1 to DLm each other through the first switch, and. A voltage corresponding to the common voltage Vcom is supplied to the data lines DL1 to DLm.

A second switch SW2 is turned on in the second operation period, and a pre-charge voltage is supplied to the data lines DL1 to DLm. Therefore, a voltage higher than the common voltage Vcom is supplied to the data lines DL1 to DLm. The output buffers 112-1 to 112-*m* are not connected to the data lines DL1 to DLm during the first and second operation periods; and, output buffers 112-1 to 112 do not operate during the first and second operation periods.

During the third operation period, a third switch SW3 disposed between output buffers 112-1 to 112-*m* and data lines DL1 to DLm is closed. The third switch SW3 is controlled by an output enable (OE) signal. During the third operation period, an OE high signal is applied to the third switch SW3 to electrically connect the output buffers 112-1 to 112-*m* and data lines DL1 to DLm.

The output buffers 112-1 to 112-*m* thus supply a data voltage from the DAC 110 to the data lines DL1 to DLm through the third switch SW3; and, output buffers 112-1 to 112-*m* do not operate during the third operation period.

That is, the output buffers 112-1 to 112-*m* operate by receiving a converted data voltage from the DAC 110 through a non-inverting input terminal. The output buffers 112-1 to 112-*m* operate during the first and second operation periods. The output buffers 112-1 to 112-*m* are connected to the data lines DL1 to DLm and supply a data voltage from the DAC 110 to the data lines DL1 to DLm during the third operation period.

During the first and second operation periods, the output buffers 112-1 to 112-*m* do not operate (OFF state); and, during the third operation period, the output buffers 112-1 to 112-*m* operate (ON state). The output buffers 112-1 to 112-*m* are controlled by the current control signal from the timing controller.

The timing controller generates the current control signal to control output buffers 112-1 to 112-*m* of the data driver 106 so that the output terminal 120 operates during the third operation period, in which data is outputted from the data driver, and the output terminal 120 does not operate during at least one of the charge-share period and the pre-charge period, in which data is not outputted from the data driver.

Figure 6:
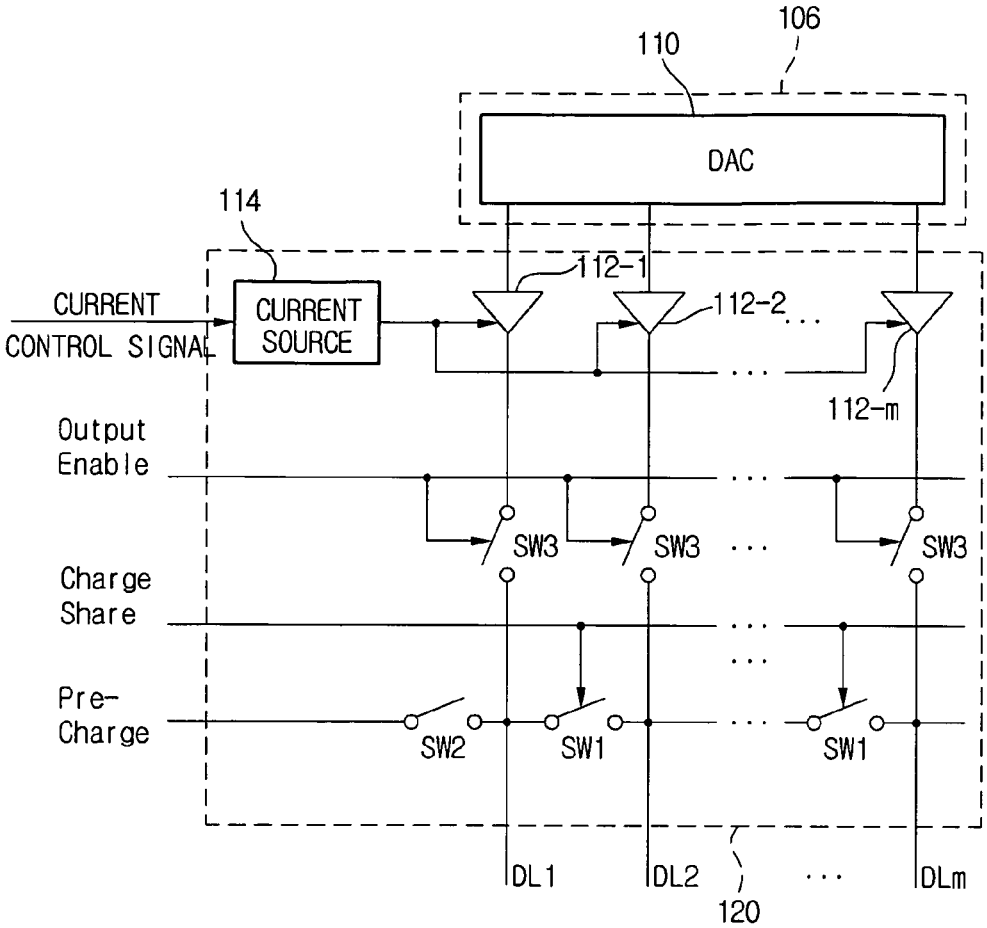
FIG. 6 is a view of an output terminal in a data driver according to a first example.

FIG. 6 is a view of an output terminal in a data driver according to a first example. During the first and second operation periods, the timing controller 108 generates and supplies a high state current control signal to the current source 114 and the current source 114 is turned off, and does not supply a driving current to the output buffers 112-1 to 112-*m*. Therefore, the output buffers 112-1 to 112-*m* do not operate during the first and second operation periods and output buffers 112-1 to 112-*m* are not connected to the data lines DL1 to DLm during the first and second operation periods.

During the first and second operation periods, first and second switches SW1 and SW2 are turned on and a voltage is supplied to the data lines DL1 to DLm. The first and second switches SW1 and SW2 are turned on when an "on" state charge share control signal and a pre-charge voltage are supplied during the first and second operation periods.

The timing controller 108 generates and supplies a low state current control signal to the current source 114 during the third operation period. The current source 114 thus is turned on and supplies a driving current to the output buffers 112-1 to 112-*m*. Therefore, the output buffers 112-1 to 112-*m* operate during the third operation period.

During the third operation period, the output buffers 112-1 to 112-*m* receive data voltages from the DAC 110 and supply the data voltages to the corresponding data lines DL1 to DLm; and, the output buffers 112-1 to 112-*m* are electrically connected to the data lines DL1 to DLm through the third switch SW3.

The third switch SW3 is turned on when a high state output enable (OE) signal is supplied during the third operation period. The output buffers 112-1 to 112-*m* are thus connected to data lines DL1 to DLm, and data voltages are supplied to corresponding data lines DL1 to DLm, so that an image corresponding to the data voltages is displayed on the liquid crystal panel 102.

During the first and second operation periods in which data is not output from the data driver, the output buffers 112-1 to 112-*m* do not operate because the current source 114 does not supply a driving current. Since the output buffers 112-1 to 112-*m* do not operate during the first and second operation periods, power consumption may be reduced. Additionally, since the output buffers 112-1 to 112-*m* do not operate during the first and second operation periods, heat which is generated from elements located inside the output buffers 112-1 to 112*m* may be reduced.

Figure 7:
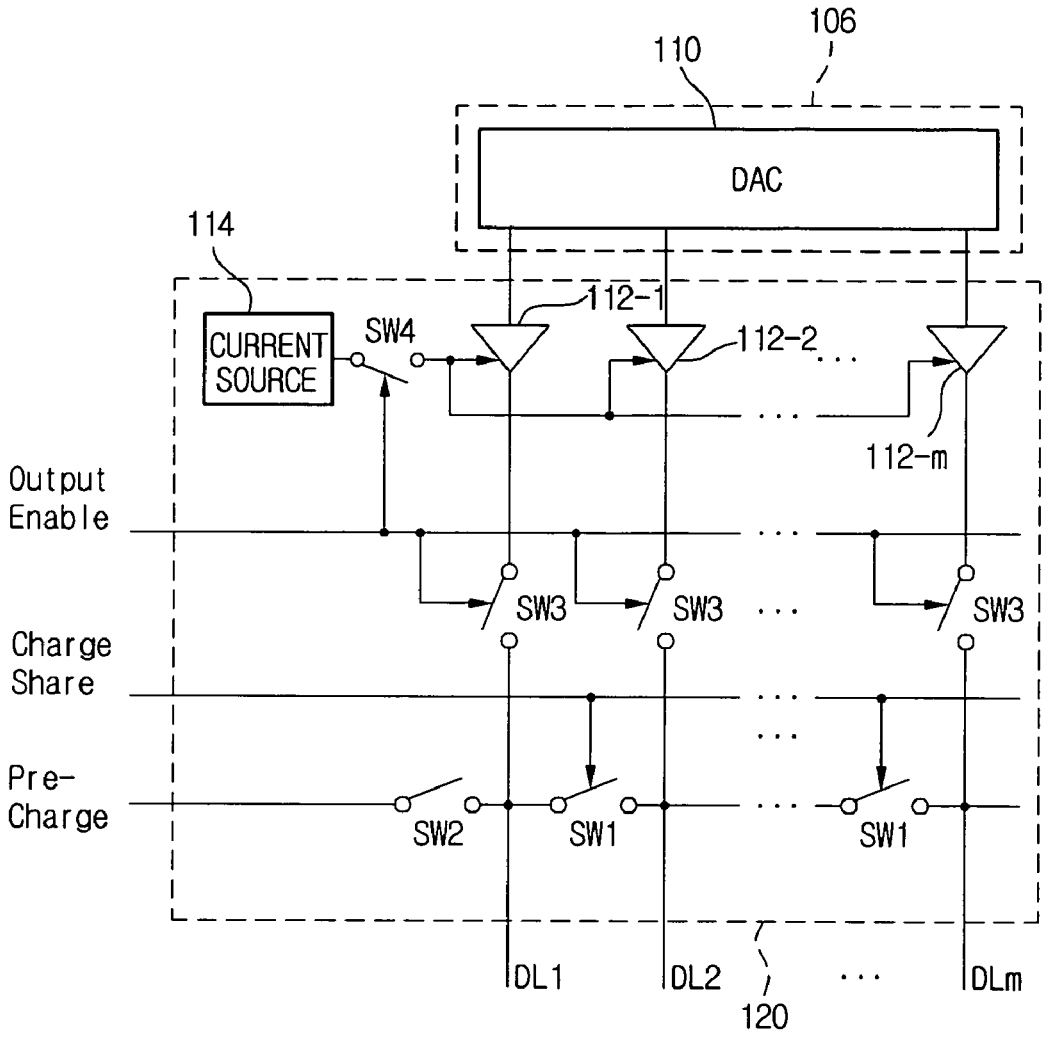
FIG. 7 is a view of an output terminal in a data driver according to a second example.

FIG. 7 is a view of an output terminal in a data driver according to a second example. The current source is connected to the output buffers 112-1 to 112-*m* through a forth switch SW4. The third switch SW3 and the forth switch SW4 are turned on when a high output enable (OE) signal is supplied during the third operation period.

The output buffers 112-1 to 112-*m* are electrically connected to the data lines DL1 to DLm through the third switch SW3 and the current source 114 is electrically connected to the output buffers 112-1 to 112-*m* through the forth switch SW4.

Therefore, the output buffers 112-1 to 112-*m* operate during the third operation period, and the output buffers 112-1 to 112-*m* do not operate during the first and second operation period.

During the first and second operation period, the output buffers 112-1 to 112-*m* do not operate because the current source 114 does not supply a driving current. Since the output buffers 112-1 to 112-*m* do not operate during the first and second operation periods, power consumption may be reduced. Additionally, since the output buffers 112-1 to 112-*m* do not operate during the first and second operation periods, heat which is generated from elements located inside the output buffers 112-1 to 112*m* may be reduced.

Figure 8:
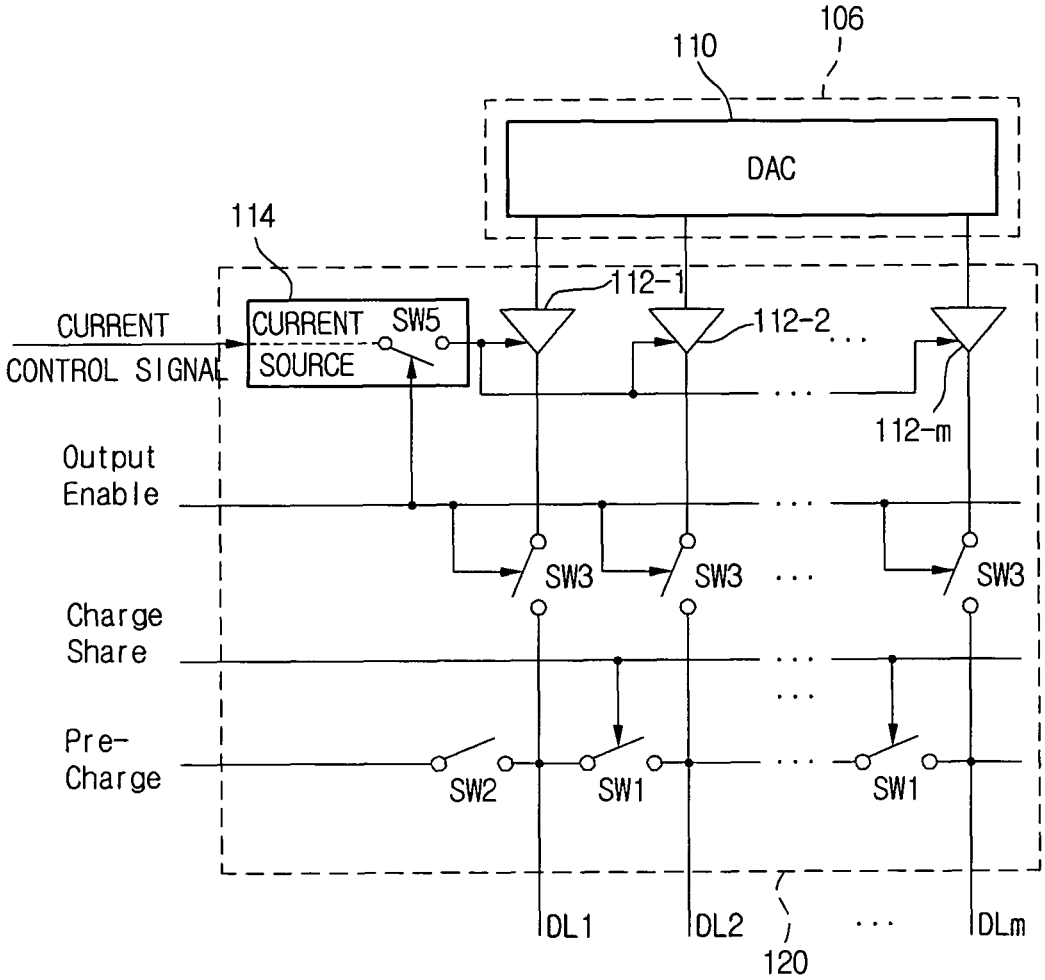
FIG. 8 is a view of an output terminal in a data driver according to a third example.

FIG. 8 is a view of an output terminal in a data driver according to a third example.

The current source 114 includes a fifth switch SW5. The fifth switch SW5 controls an operation of the current source 114. The timing controller 108 generates and supplies a current control signal to the current source 114 and the current source 114 is turned on/off.

During the first and second operation periods, first and second switches SW1 and SW2 are turned on and a voltage is supplied to the data lines DL1 to DLm. The first and second switches SW1 and SW2 are turned on when an "on" state charge share control signal and a pre-charge voltage are supplied during the first and second operation periods. At the same time, The third and fifth switches SW3 and SW5 are turned off and, the output buffers 112-1 to **112-*m* do not operate because the output buffers 112-1 to 112-*m* do not receive a driving current from the current source 114**.

During the third operation period, the output buffers 112-1 to **112-*m* are electrically connected to the data lines DL1 to DLm through the third switch SW3 and the current source 114 operates and supplies the driving current to the output buffers 112-1 to 112-*m* by the fifth switch SW5. At the same time, the first and second switches SW1 and SW2** are turned off.

Therefore, the output buffers 112-1 to **112-*m* operate during the third operation period because the output buffers 112-1 to 112-*m* receive the driving current from the current source 114**.

During the first and second operation period, the output buffers 112-1 to **112-*m* do not operate because the current source 114 does not supply a driving current. Since the output buffers 112-1 to 112-*m* do not operate during the first and second operation periods, power consumption may be reduced. Additionally, since the output buffers 112-1 to 112-*m* do not operate during the first and second operation periods, heat which is generated from elements located inside the output buffers 112-1 to 112*m*** may be reduced.

Figure 9:
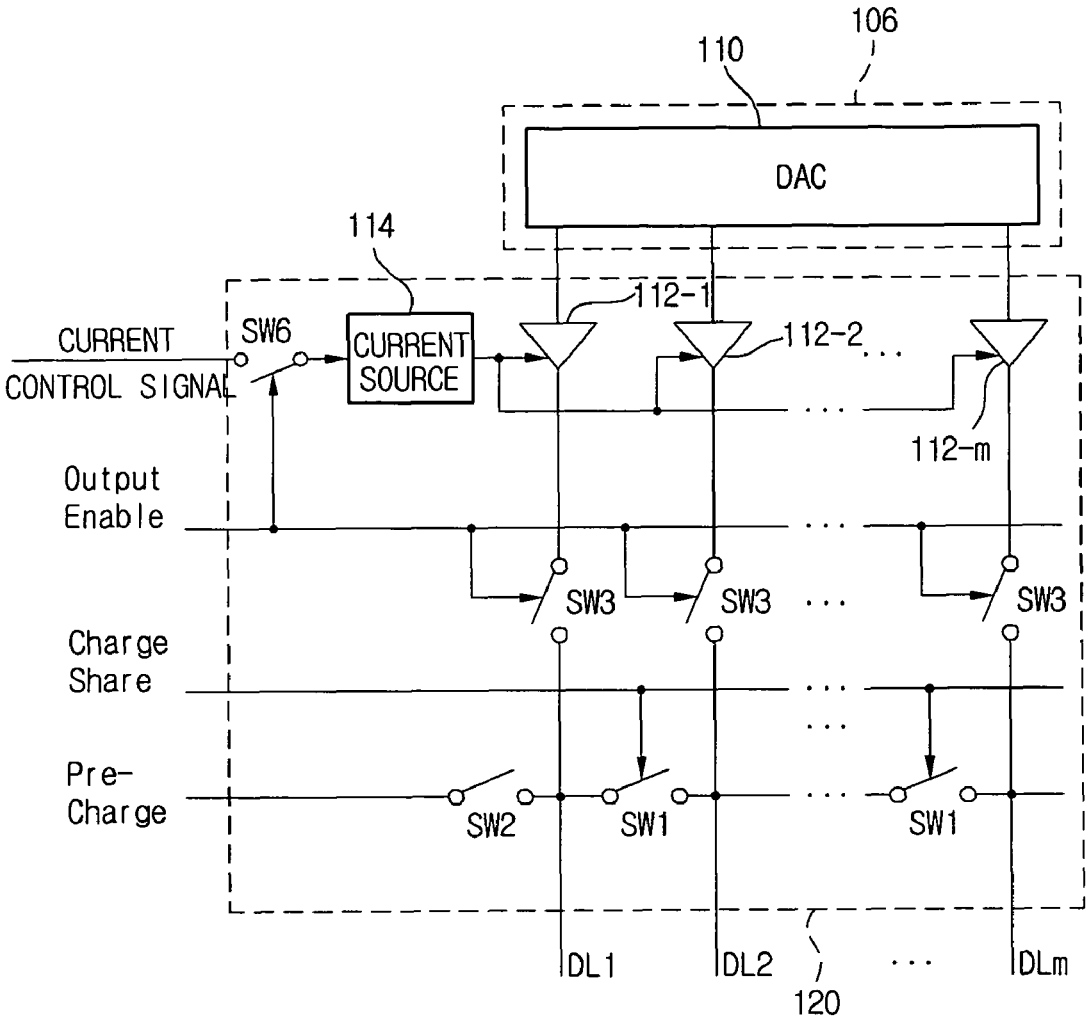
FIG. 9 is a view of an output terminal in a data driver according to a fourth example.

FIG. 9 is a view of an output terminal in a data driver according to a forth example.

The current source is connected to the output buffers 112-1 to **112-*m*. and the current source 114 receives a current control signal from the timing controller (not shown) through a sixth switch SW6. The third and sixth switches SW3 and SW6** are turned on when a high state output enable (OE) signal is supplied during the third operation period.

During the third operation period, the output buffers 112-1 to **112-*m* are electrically connected to the data lines DL1 to DLm through the third switch SW3 and the current source 114 receives the current control signal from the timing controller through the sixth switch SW6. The current source is electrically connected to the output buffers 112-1 to 112-*m*** through the current control signal.

Therefore, the output buffers 112-1 to **112-*m* operate during the third operation period, and the output buffers 112-1 to 112-*m*** do not operate during the first and second operation period.

During the first and second operation period, the output buffers 112-1 to **112-*m* do not operate because the current source 114 does not supply a driving current. Since the output buffers 112-1 to 112-*m* do not operate during the first and second operation periods, power consumption may be reduced. Additionally, since the output buffers 112-1 to 112-*m* do not operate during the first and second operation periods, heat which is generated from elements located inside the output buffers 112-1 to 112*m*** may be reduced.

It will be understood by persons of skill in the art that the switches described herein may be shown as contact closures for clarity of illustration of function, and may be implemented by any means performing the switching function. For example, the switches may be at least one of a NMOS transistor, a PMOS transistor, a CMOS transistor, a diode, a bipolar transistor, or the like.

Figure 10:
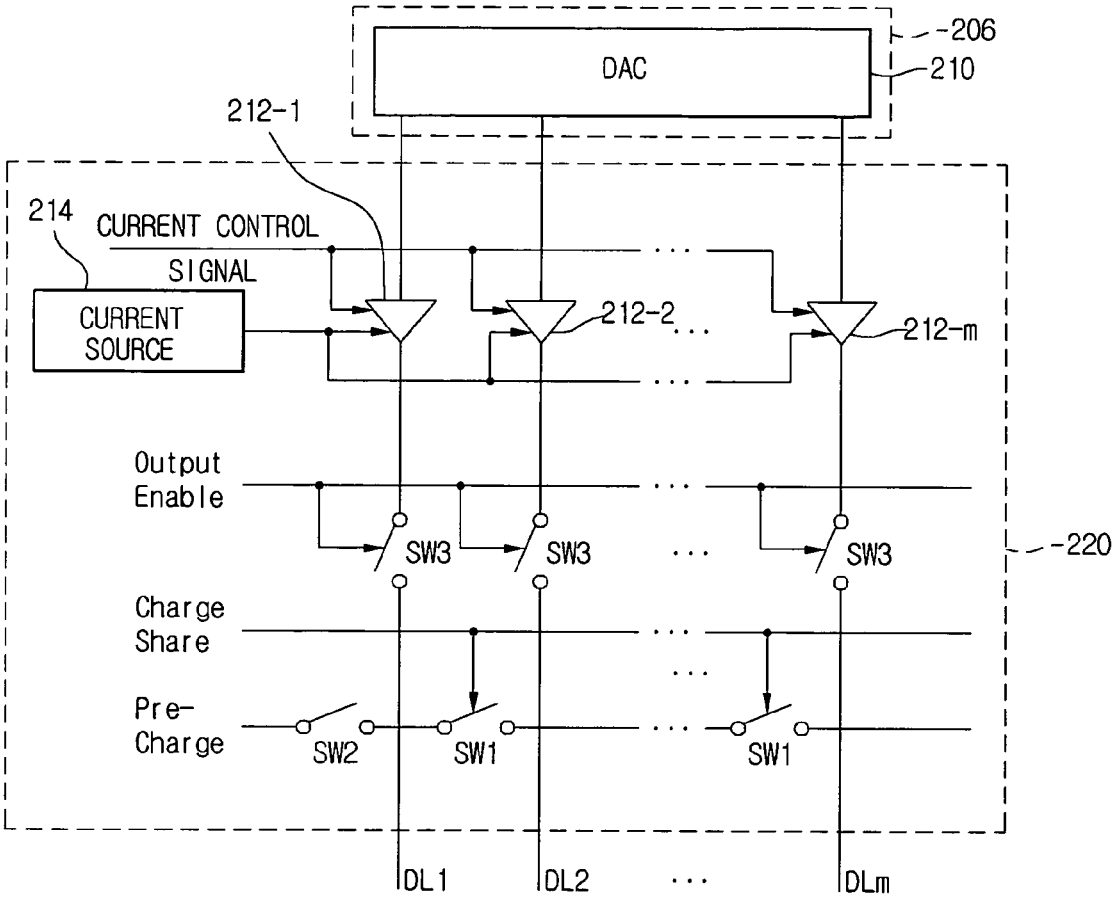
FIG. 10 is a view of an output terminal in a data driver according to a fifth example.

FIG. 10 is a view of an output terminal in a data driver according to a fifth example.

The data driver 206 supplies a data voltage (an analog voltage) to the data lines DL1 to DLm according to a control signal supplied form the timing controller. An output terminal 220 of the data driver 206 (hereinafter, referred to as an output terminal) includes a plurality of output buffers 212-1 to **212-*m* corresponding to the data lines DL1 to DLm. The output buffers 212-1 to 212-*m* are supplied with a driving current from a current source 214**.

The output buffers 212-1 to **212-*m* are controlled by the current control signal supplied from the timing controller. For example, when the current control signal is a high state during the first and second operation period, the output buffers 212-1 to 212-*m* do not operate, and when the current control signal is a low state during the third operation period, the output buffers 212-1 to 212-*m*** operate.

Figure 11:
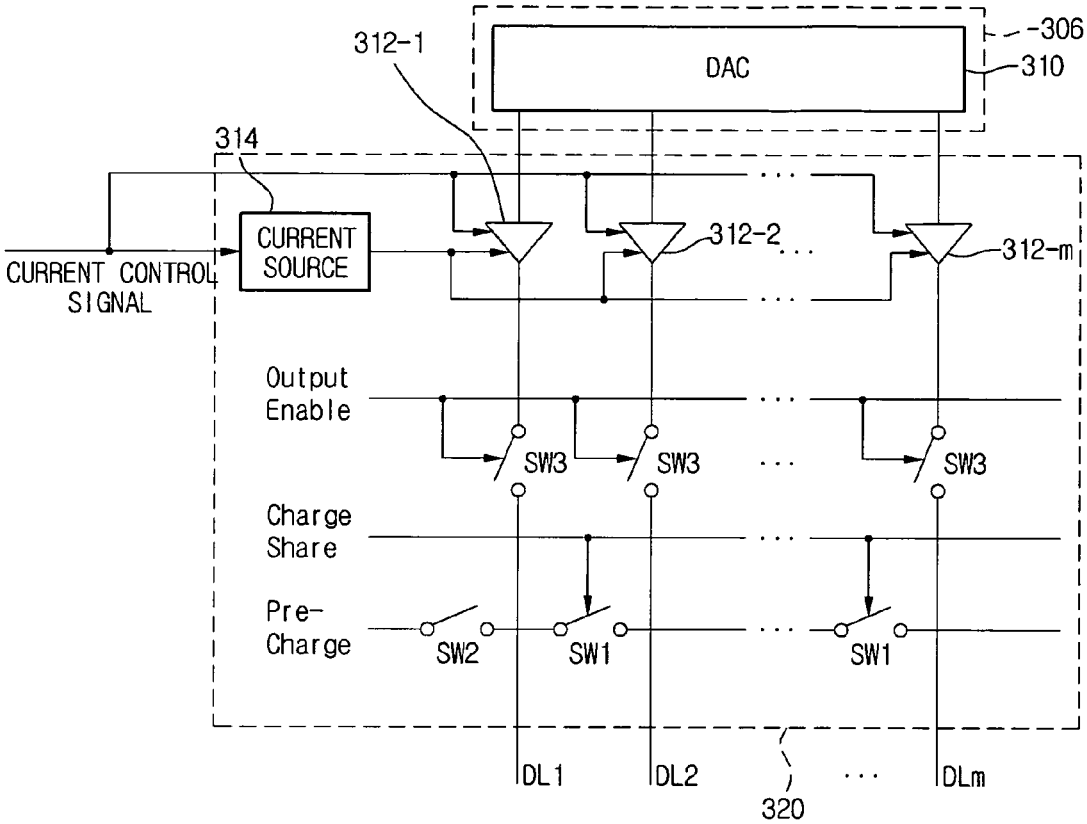
FIG. 11 is a view of an output terminal in a data driver according to a sixth example.

FIG. 11 is a view of an output terminal in a data driver according to a sixth example. The current source 314 and the output buffers 312-1 to **312-*m*** receive a current control signal generated from the timing controller.

During the first and second operation periods, the timing controller generates and supplies a high state current control signal to the current source 314 and the output buffers 312-1 to **312-*m*. And the current source 314 is turned off, and the output buffers 312-1 to 312-*m*** do not operate during the first and second operation periods.

During the third operation period, the timing controller generates and supplies a low state current control signal to the current source 314 and the output buffers 312-1 to **312-*m*. The current source 314 is turned on, and the output buffers 312-1 to 312-*m*** operate during the third operation period.

During the third operation period, the output buffers 312-1 to **312-*m* receive data voltages from the DAC 310 and supply the data voltages to the corresponding data lines DL1** to DLm.

The output buffers 312-1 to **312-*m* do not operate during the first and second operation periods, power consumption may be reduced. Additionally, since the output buffers 312-1 to 312-*m* do not operate during the first and second operation periods, heat which is generated from elements located inside the output buffers 312-1 to 312*m*** may be reduced.

FIG. **12*a* is a view of an output buffer in the data driver of FIG. 11**.

A first output buffer 312-1 shown in FIG. **12*a* includes an operational amplifier 316, two transistors TR1 and TR2, two switches SW7 and SW8, and an inverter 318**.

During the first and second operation periods, the low state current control signal is supplied to the seventh switch SW7 and the inverter 318. The low state current control signal is converted into a low signal through the inverter 318 and then supplied into the eighth switch SW8.

The seventh switch SW7 is turned off by the low state current control signal, and the eighth switch SW8 is turned on by the high state current control signal.

When the eighth switch SW8 is turned on, a power supply voltage Vdd is supplied to a gate terminal of the first transistor TR1. Simultaneously, the power supply voltage Vdd is supplied to a source terminal of the first transistor TR1.

Therefore, a voltage Vg supplied to the gate terminal of the first transistor TR1 and a voltage Vs supplied to the source terminal of the first transistor TR1 become equal. A current does not flow between the source and drain terminals when the voltage Vg supplied to the gate terminal of the first transistor TR1 and a voltage Vs supplied to the source terminal of the first transistor TR1 are equal. Consequently, the first output buffer 212-1 does not operate during the first and second operation periods.

A high state current control signal generated by the timing controller and supplied to the seventh switch SW7 and the inverter 318 during the third operation period. The high state current control signal supplied to the inverter 318 is converted into a low signal, and supplied to the eighth switch SW8. The seventh switch SW7 is tuned on by the high state current control signal, and the eighth switch SW8 is turned off by the high state current control signal.

When the seventh switch SW7 is turned on, a bias voltage supplied by the operational amplifier 316 is supplied to the gate terminal of the first transistor TR1 through the seventh switch SW7. The bias voltage differs from that of the power supply voltage Vdd, and the power supply voltage Vdd is supplied from the source terminal to the drain terminal in the first transistor TR1.

Since a voltage Vg supplied to the gate terminal of the first transistor TR1 is the bias voltage, and a voltage Vs supplied to the source terminal is the power supply voltage Vdd, a current flows from the source terminal to the drain terminal of the first transistor TR1. Since a current flows from the source to and drain terminal in the first transistor TR1, the first output buffer 312-1 operates in response to the high state current control signal supplied from the timing controller during the third operation period.

Figure 12A:
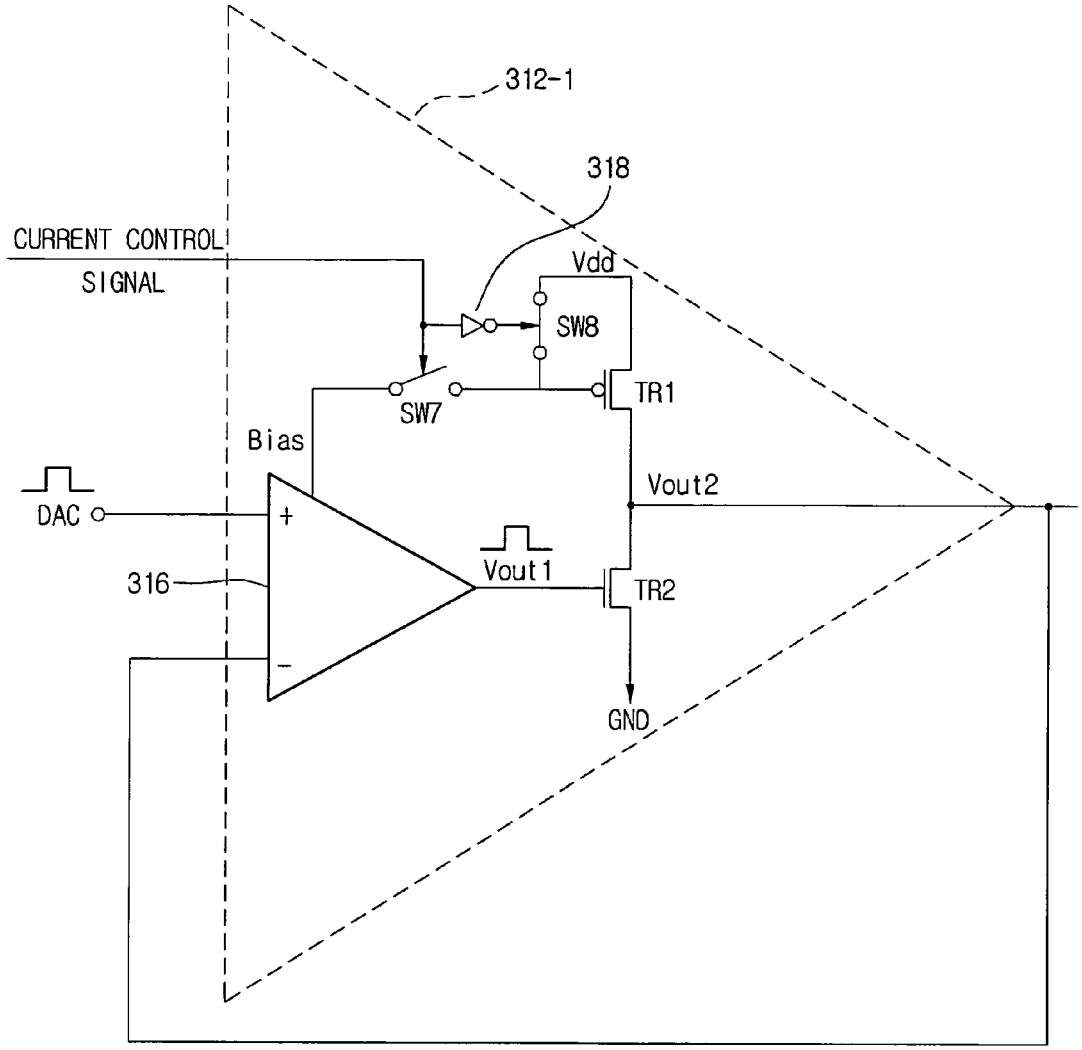
FIG. 12A is a view of an output buffer in the data driver of FIG. 11.
Figure 12B:
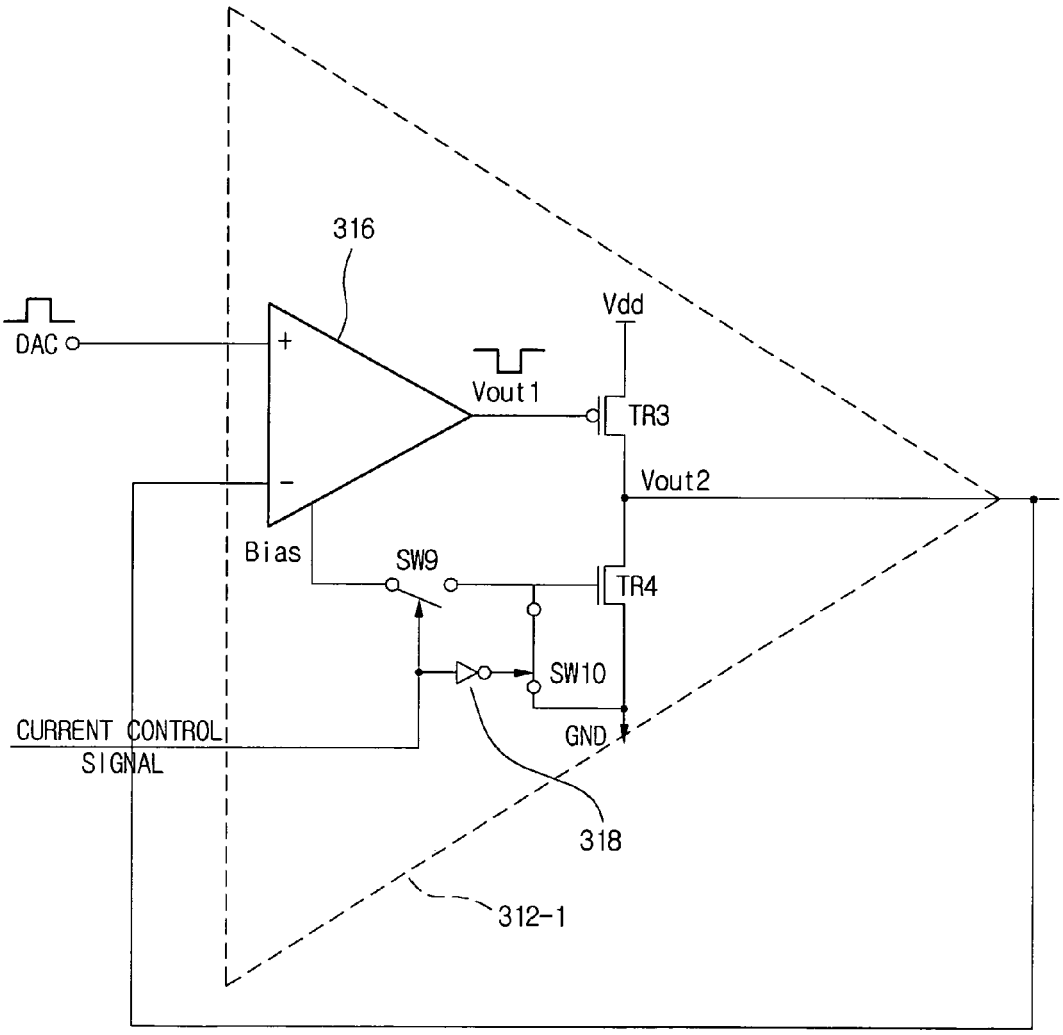
FIG. 12B is a view of another output buffer in the data driver of FIG. 11.

FIG. 12*b* is a view of another output buffer in the data driver of FIG. 11. A first output buffer 312-1 includes an operational amplifier 316, two transistors TR3 and TR4, two switches SW9 and SW10, and an inverter 318.

During the first and second operation periods, the timing controller supplies a low state current control signal to the ninth switch SW9 and the inverter 318. The low state current control signal supplied to the inverter 318 is converted into a high signal, and supplied to the tenth switch SW10.

Accordingly, the ninth switch SW9 is turned off by the low state current control signal, and the tenth switch SW10 is turned on by the high state current control signal.

When the tenth switch SW10 is turned on, a ground voltage GND is supplied to a gate terminal of the fourth transistor TR4. The ground voltage GND is also supplied to a source terminal of the fourth transistor TR4. A voltage Vg supplied to the gate terminal of the fourth transistor TR4 and a voltage Vs supplied to the source terminal of the fourth transistor TR4 become equal as the ground voltage GND.

Due to characteristics of the fourth transistor TR4, when a voltage Vg supplied to the gate terminal of the fourth transistor TR4 and a voltage Vs supplied to the source terminal of the fourth transistor TR2 become equal, a current does not flow between the source and drain terminals in the fourth transistor TR4. Therefore, the first output buffer 312-1 does not operate during the first and second operation periods.

The timing controller supplies a high state current control signal to the ninth switch SW9 and the inverter 318 during the third operation period. The high state current control signal supplied to the inverter 318 is converted into a low signal, and then supplied to the tenth switch SW10.

Accordingly, the ninth switch SW9 is turned on by the high state current control signal, and the tenth switch SW10 is turned off by the low state current control signal.

When the ninth switch SW9 is turned on, a bias voltage is supplied to the gate terminal of the fourth transistor TR4. A ground voltage GND is supplied to the source terminal of the fourth transistor TR4. The bias voltage is different from the ground voltage GND.

A voltage Vg supplied to the gate terminal of the fourth transistor TR4 is the bias voltage, and a voltage Vs supplied to the source terminal is the ground voltage GND.

Consequently, since the voltage Vg supplied to the gate terminal of the fourth transistor TR4 is different from the voltage Vs supplied to the source terminal of the fourth transistor TR4, a current flows between the source and drain terminals in the fourth transistor TR4.

Thus, when the low state current control signal is supplied from the timing controller to the output buffers during the first and second operation periods, the output buffers do not operate.

When the high state current control signal supplied from the timing controller to the output buffers, the output buffers operate during the third operation period. Since output buffers do not operate during the first and second operation periods, power consumption decreases and less heat is generated by elements inside the output buffers.

As described above, the LCD does not operate an output terminal of a data driver using a current control signal during at least one period of a charge share period and a pre-charge period, and operates the output terminal of the data driver only during a data output period. Thus, current consumption is minimized and also power consumption can be reduced, and heat generated from elements in the data driver can be reduced.

The LCD operates an output terminal of the data driver only when displaying of an actual image. Therefore, a current consumption is reduced and thus power consumption is reduced and a heat generated from the elements can be reduced.

Although the present invention has been explained by way of the examples described above, it should be understood to the ordinary skilled person in the art that the invention is not limited to the examples, but rather that various changes or modifications thereof are possible without departing from the spirit of the invention. Accordingly, the scope of the invention shall be determined only by the appended claims and their equivalents.

What is claimed is:

1. A liquid crystal display device comprising:

a liquid crystal panel having a plurality of gate lines and data lines;

a data driver including a digital-to analog converter (DAC) supplying a data voltage to the plurality of data lines;

first switches between the data lines;

a second switch connecting one of the data lines;

third switches on the data lines between the DAC and the liquid crystal panel;

a buffer unit on the data lines between the DAC and the third switches;

a gate driver supplying a scan signal to the plurality of the gate lines; and a controller that generates at least three signals for driving the liquid crystal panel during first to third periods, wherein the buffer unit comprises:

a plurality of output buffers corresponding to the data lines; and a current source between a controller and the output buffers, wherein during the first period, the first switches are turned on under the control of a first signal to be short-circuited between the data lines and then charge the data lines with a common voltage, the second switch is turned off under the control of a second signal, the third switches are turned off under the control of a third signal, and the output buffers are inactivated under the control of a driving current from the current source under the control of a fourth signal.

2. The liquid crystal display device according to claim 1, wherein during the second period, the first switches are turned on under the control of the first signal to be short-circuited between the data lines, the second switch is turned on under the control of the second signal to charge the data lines with a pre-charge voltage, the third switches are turned off under the control of the third signal, and the output buffers are inactivated under the control of the driving current from the current source under the control of the fourth signal.

3. The liquid crystal display device according to claim 2, wherein during the third period, the first switches are turned off under the control of the first signal to be disconnected between the data lines, the second switch is turned off under the control of the second signal, the third switches are turned on under the control of the third signal, and the output buffers are activated under the control of the driving current from the current source under the control of the fourth signal to supply the data voltage from the DAC to the data lines.

4. A liquid crystal display device comprising:

a liquid crystal panel having a plurality of gate lines and data lines;

a data driver including a digital-to analog converter (DAC) supplying a data voltage to the plurality of data lines;

first switches between the data lines;

a second switch connecting one of the data lines;

third switches on the data lines between the DAC and the liquid crystal panel;

a buffer unit on the data lines between the DAC and the third switches;

a gate driver supplying a scan signal to the plurality of the gate lines; and a controller that generates at least three signals for driving the liquid crystal panel during first to third periods, wherein the buffer unit comprises:

a plurality of output buffers corresponding to the data lines;

a current source connected to the controller; and a fourth switch between the current source and the output buffers, wherein during the first period, the first switches are turned on under the control of a first signal to be short-circuited between the data lines and then charge the data lines with a common voltage, the second switch is turned off under the control of a second signal, the third switches are turned off under the control of a third signal, the fourth switch is turned off under the control of the third signal to be disconnected between the current source and the output buffers, and the output buffers are inactivated in the absence of a driving current from the current source.

5. The liquid crystal display device according to claim 4, wherein during the second period, the first switches are turned on under the control of the first signal to be short-circuited between the data lines, the second switch is turned on under the control of the second signal to charge the data lines with a pre-charge voltage, the third switches are turned off under the control of the third signal, the fourth switch is turned off under the control of the third signal, and the output buffers and the output buffers are inactivated in the absence of the driving current from the current source.

6. The liquid crystal display device according to claim 5, wherein during the third period, the first switches are turned off under the control of the first signal to be disconnected between the data lines, the second switch is turned off under the control of the second signal, the third switches are turned on under the control of the third signal, the fourth switch is turned on under the control of the third signal to supply the driving current to the output buffers, and the output buffers are activated under the control of the driving current to supply the data voltage from the DAC to the data lines.

7. A liquid crystal display device comprising:

a liquid crystal panel having a plurality of gate lines and data lines;

a data driver including a digital-to analog converter (DAC) supplying a data voltage to the plurality of data lines;

first switches between the data lines;

a second switch connecting one of the data lines;

third switches on the data lines between the DAC and the liquid crystal panel;

a buffer unit on the data lines between the DAC and the third switches;

a gate driver supplying a scan signal to the plurality of the gate lines; and a controller that generates at least three signals for driving the liquid crystal panel during first to third periods, wherein the buffer unit comprises:

a plurality of output buffers corresponding to the data lines;

a current source connected to the data lines; and a fourth switch between the controller and the current source, wherein during the first period, the first switches are turned on under the control of a first signal to be short-circuited between the data lines and then charge the data lines with a common voltage, the second switch is turned off under the control of a second signal, the third switches are turned off under the control of a third signal, the fourth switch is turned off under the control of the third signal to be disconnected between the controller and the current source, and the output buffers are inactivated in the absence of the fourth signal.

8. The liquid crystal display device according to claim 7, wherein during the second period, the first switches are turned on under the control of the first signal to be short-circuited between the data lines, the second switch is turned on under the control of the second signal to charge the data lines with a pre-charge voltage, the third switches are turned off under the control of a third signal, the fourth switch is turned off under the control of the third signal to be disconnected between the controller and the current source, and the output buffers are inactivated in the absence of the fourth signal.

9. The liquid crystal display device according to claim 8, wherein during the third period, the first switches are turned off under the control of the first signal to be disconnected between the data lines, the second switch is turned off under the control of the second signal, the third switches are turned on under the control of a third signal, the fourth switch is turned on under the control of the third signal to be short-circuited between the controller and the current source, and the output buffers are activated under the control of the driving current from the current source under the control of the fourth signal to supply the data voltage from the DAC to the data lines.

* * * * *